US006125609A

United States Patent [19]

Parsons

[11] Patent Number: 6,125,609

[45] Date of Patent: Oct. 3, 2000

[54] ROOFING SHINGLE ASSEMBLY

[76] Inventor: Colbey Parsons, 25 S. Broadway, Greenfield, Ind. 46140

[21] Appl. No.: 09/296,507

[22] Filed: Apr. 22, 1999

[51] Int. Cl.[7] ..... E04D 1/00

[52] U.S. Cl. ..... 52/794.1; 52/518; 52/309.8; 52/408

[58] Field of Search ..... 52/518, 309.8, 52/746.11, 408

[56] References Cited

U.S. PATENT DOCUMENTS

| | | | |
|---|---|---|---|
| 4,450,663 | 5/1984 | Watkins | 52/309.4 |
| 5,258,222 | 11/1993 | Crivelli | 428/323 |
| 5,382,475 | 1/1995 | Kayser | 428/403 |
| 5,411,803 | 5/1995 | George et al. | 428/403 |
| 5,540,022 | 7/1996 | Morris | 52/309.8 |

*Primary Examiner*—Carl D. Friedman
*Assistant Examiner*—Jennifer I. Thissell

[57] ABSTRACT

A roofing shingle design and method of use which achieves a high degree of thermal insulation for a building without the use of conventional insulating materials. A middle or internal layer of borosilicate is incorporated into a conventional roofing shingle. Such a mass-produced roofing shingle greatly reduces the time and costs involved to install conventional insulative materials.

1 Claim, 1 Drawing Sheet

ROOFING SHINGLE ASSEMBLY

BACKGROUND AND OBJECTS OF THE INVENTION

The present invention is generally related to the construction arts and, in particular, to a novel method and design for providing improved insulation in building structures.

The need for home roofing insulation to save energy costs is well-known in the art. Such is typically done by providing insulative strips 15 between roofing beams 10 as indicated in the drawing FIG. 1.

While such prior art methods are effective to reduce heating or cooling losses, they are relatively costly and labor-intensive to install.

Accordingly, it is an object of the present invention to demonstrate a roofing insulation method which may be easily installed without using the time-consuming labor methods of the prior art.

It is also an object of the invention to set forth an insulative roofing shingle design which may be economically mass-produced for widespread commercial appeal.

It is a still further object of the invention to show a novel roofing design which utilizes available insulative materials in ways which have not heretofore been known.

These and other objects and advantages of the invention will be apparent from the description which follows.

PRIOR ART PATENTS AND DESIGNS

U.S. Pat. Nos. 5,258,222 and 5,600,929 are considered to be generally related to the present invention.

They do not show, however, the specific roofing shingle combination of the invention disclosed herein.

SUMMARY OF THE INVENTION

The design utilizes highly insulative materials such as borosilicates as a mid-layer or internal layer within conventional roofing shingles.

Such usage enables insulation to be effectively installed as part of the roofing process to reduce installation costs and provide a more effective insulation barrier.

The design may be economically manufactured for large-scale sales in the roofing and construction markets.

DESCRIPTION OF THE DRAWING FIGURE

The drawing FIGURE illustrates, in schematic form, prior art insulation uses and the novel methods and construction of the present invention.

DESCRIPTION OF A PREFERRED EMBODIMENT

Figure 1:
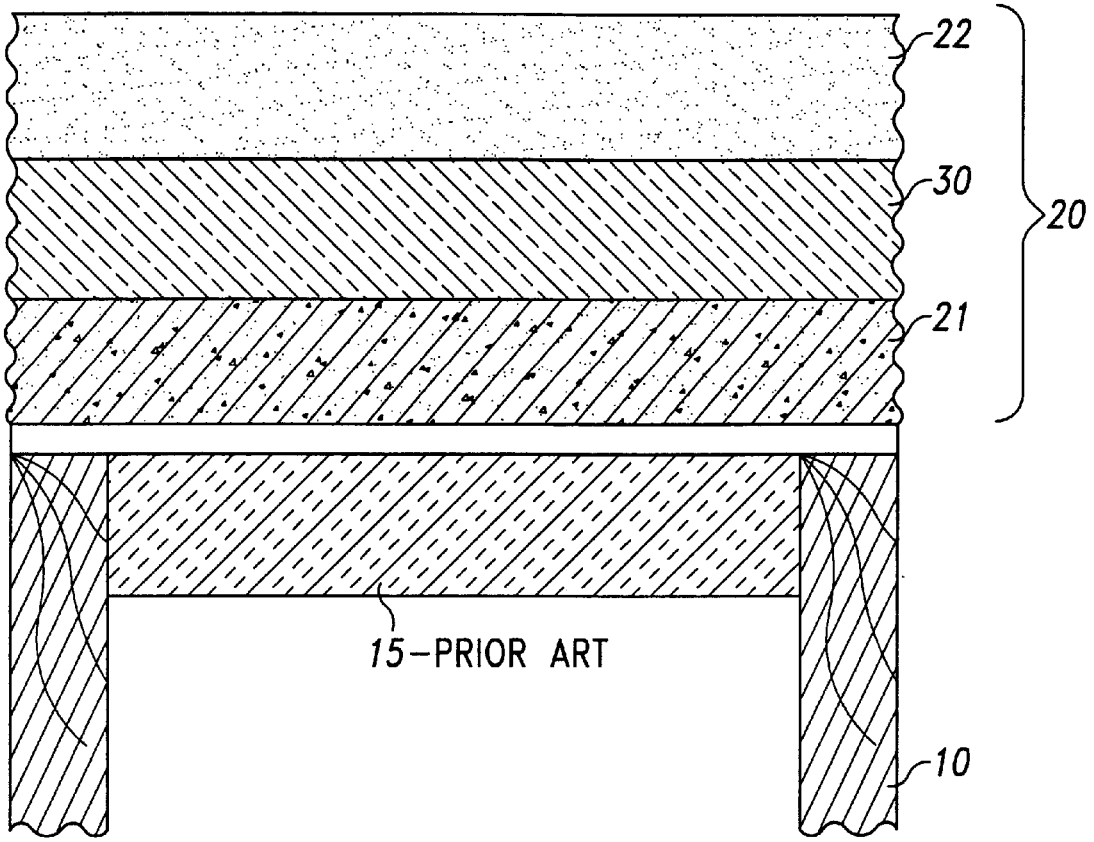

Referring to the drawing FIGURE, the conventional roofing beams and insulative strip methods are indicated at numerals 10 and 15. Such methods typically require separate and costly labor installation time.

A roofing shingle 20, in conventional use, would have a lower substrate or layer 21 comprised of an asphalt/tar compound known in the art. The shingle would also be comprised of an upper layer 22 of roofing granules also known in the art.

In accord with the present invention, it has been discovered that a mid-layer 30 may be effectively placed within the shingle to provide an insulative boundary.

It has been further discovered that materials such as borosilicates may be used as part of the roofing shingle to provide such insulative effect. The combined borosilicate and shingle usage thus eliminates the need for other more costly insulation methods.

Borosilicates are any of several salts derived from both boric acid and silicic acid and found in certain minerals such as tourmaline.

It is intended to claim the broad use of borosilicates with any type of roofing or other shingles currently used in the art.

Because of its high bonding properties, borosilicate may be combined with the granular layer 22 or located on top of said layer in practice of the invention.

The bonding properties of borosilicate also mean that the invention combined roofing shingle may be readily mass-produced to supply the large quantities needed in the art.

While a particular design has been shown and described, it is intended to cover all equivalent structures and uses which would reasonably occur to those of skill in the art.

I claim:

1. A roofing shingle positioned on the top of a wooden roof to provide economical insulation for a building structure, said roofing shingle consisting of three layers, a first layer of granular roofing material adjacent to the exterior environment, a middle layer consisting of borosilicate a third lower layer of roofing tar material in contact with said wooden roof, said roofing shingle consisting of the three above-described layers and being devoid of other materials, layers, or additives, said roofing shingle does not provide lower insulation, said roofing shingle is mounted or attached to a wooden roof of a building having wooden beams, said three layers being separate and distinct from each other and not mixed together.

* * * * *